US006799885B2

(12) United States Patent
Bryant

(10) Patent No.: US 6,799,885 B2
(45) Date of Patent: Oct. 5, 2004

(54) METHOD OF IMPROVING THE FUNCTION OF AN HOUR-GLASS

(76) Inventor: Terry Keith Bryant, 1281 E. Blue Heron Blvd., Riveria Beach, FL (US) 33404

( * ) Notice: Subject to any disclaimer, the term of this patent is extended or adjusted under 35 U.S.C. 154(b) by 123 days.

(21) Appl. No.: 09/900,599

(22) Filed: Jul. 9, 2001

(65) Prior Publication Data

US 2003/0007423 A1 Jan. 9, 2003

(51) Int. Cl.[7] ..... G04F 1/04
(52) U.S. Cl. ..... 368/93; 368/95
(58) Field of Search ..... 368/93–95, 284

(56) References Cited

U.S. PATENT DOCUMENTS 3,125,849 A * 3/1964 Wachtel ..... 368/93
4,267,588 A * 5/1981 Daniels ..... 368/93
5,023,852 A * 6/1991 Mikels ..... 368/93
6,260,996 B1 * 7/2001 Coleman, Jr. ..... 368/93

FOREIGN PATENT DOCUMENTS

CH 621670 A * 2/1981 ..... 368/93

* cited by examiner

*Primary Examiner*—David Martin
*Assistant Examiner*—Jeanne-Marguerite Goodwin

(57) ABSTRACT

The method of dramatically speeding up the time it takes for sand, mercury, or water, or other like substances to flow from the upper compartment to the lower compartment of an hour-glass, usually in an hour but not specifically required in this method, entails the use of a premolded clear flexible polymer or any component similar, with the same flexibility properties, molded in the basic shape of an hour-glass, in which one can open the flow canal, which is a hole located in the center of the hour-glass, through the application of applying pressure directly to the above said flexible pre-molded polymer shape. The process of flexing this pre-molded form will permit the sand or other like substance to run between the upper and lower compartments of the hour-glass, allowing the above said substances to run through a wider and larger flow canal, from the upper compartment to the lower compartment. Thus, making the hour-glass work more efficiently.

4 Claims, 1 Drawing Sheet

METHOD OF IMPROVING THE FUNCTION OF AN HOUR-GLASS

BACKGROUND OF THE INVENTION

1. Field of Invention

The present invention relates to the improvement of the already existing invention normally known as the hour-glass, in which a glass vessel is used for the measuring of time in which sand, or other appropriate components or substances run from an upper compartment to a lower compartment and the time for these components to run through the compartments equal the amount of time related to the portion of the component being used. By using clear flexible polymer compartments in the basic shape of an hour-glass, or using a similar or like material with flexible properties and the utilization of a form which allows sand, or appropriate like material to run from the upper compartment into the lower compartment of the hour-glass more quickly by pressing on the sides of the hour-glass the flow canal, located in the center of the hour-glass, will open allowing the lower compartment to be filled. The flexible form will then immediately return to it's original shape once pressure is released, thus, improving the waiting time between uses and the efficiency of the hour-glass.

2. Description of Prior Art

Techniques for measuring time using an hour-glass are accomplished normally using glass molded into the desired shape which allows sand or whatever appropriate substances to travel from the upper compartment to a lower compartment using gravity to pull the sand into the lower compartment through the flow canal which, is a small opening in the center of the hour-glass; between the upper and lower compartments. In order to begin the process of the amount of time it takes the aforementioned substances to travel through the flow canal in the hour-glass, one must wait for the complete transference of the substance in the upper compartment to the lower, as the amount of the material being transferred from the upper compartment to the lower compartment evaluates the exact amount of time the hour-glass is capable of measuring. The above method requires the user to manual turn the hour-glass upside-down to begin the timing process again, which makes the process inoperative for providing an immediate use of the hour-glass as one must always wait for the completion of this transfer from the upper to the lower compartment, and thus, making it time consuming. An advantage of the flexible new design which allows the sand or other substances to be transferred immediately by pressing on the sides of the polymer hour-glass mold and the flow canal, is that on can immediately use the hour-glass without having to wait, as the flexible mold will return to it's shape once pressure is released. Due to the nonflexibility of glass, or even nonflexible plastic this has previously been impossible to due in prior art functions. A disadvantage of prior art was that many times the hour-glass was stored in a game box or in the kitchen, and would easily fall onto it's side, which caused the enclosed material which is normally transferred from the upper compartment of the hour-glass to the lower to settle in both compartments. In order to begin using the prior art again one would have to place the hour-glass back into the up-right position and wait for the process of gravitational pull to transfer the sand, or other substance through the flow canal before one could use the hour-glass to get an accurate time. The solution to this age old problem of how to swiftly use an hour-glass, without having to w wait, has probably been a question in the back of the minds of people throughout history and the complacency was that after over a thousand years of using this apparatus with the same principles applying, we became blinded to the answer. This could be due to the fact that in this modern age of technology the use of polymers and like materials instead of glass, is basicly still a new frontier. The advantage of this new method is that one can use the hour-glass without delay, through the employment of modern technology, to provide a source for measuring time, by simply opening the the flexible flow canal and allowing the sand, or other substances to move immediately between the upper and lower compartments and fill the desired compartment as one chooses, providing a more operable hour-glass.

SUMMARY OF INVENTION

The present invention provides the user an immediate response to clearing the flow canal located between the upper and lower compartments of an hour-glass, so that the user can begin measuring time at the fastest possible speed, anytime, anywhere, in order that one can, for whatever purpose, use the hour-glass without much delay. This new application will help speed up a game which requires an hour glass, or simply prevent the user from waiting to cook an egg, or for whatever purpose one is using the hour-glass in order to measure time more effeciently. This is accomplished by molding clear flexible polymer, or any material with like clearness and flexibility, in the shape of the preferred hour-glass, with the ability and resilience to retain the original shape normally sand, or similar substance is allowed to run through dramatically increasing the time it takes the sand, or like material to flow from the upper compartment of the hour-glass. Thus, expediting the time the user has to wait, while enhancing the properties of the abilities to measure time using an hour-glass with this new application, providing a time saving step for whatever the purpose; from a game, to cooking, or simply a way to evaluate an amount of time.

A more thorough and comprehensive understanding may be had from the detailed description of the preferred embodiment when read in connection with the drawings.

BRIEF DESCRIPTION OF THE DRAWINGS

The present invention will be more fully understood by reference to the following detailed description hereof when read in conjunction with the attached drawings, and wherein.

DETAILED DESCRIPTION OF THE PREFERRED EMBODIMENT

Figure 1:
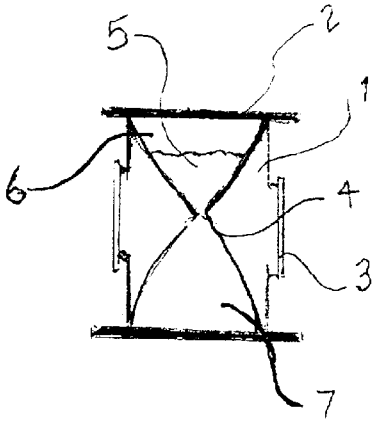
FIG. 1 is a front view a flexible clear premolded polymer, or like substance in the basic shape of and hour-glass (1) showing the covering, though not confined to this exact shape, for keeping the sand contained (2) the areas provided, however not confined to this exact shape, for pressing (3) the flexible mold (1) to release the sand or appropriate substances (5) from the upper compartment (6) into the lower compartment (7) by opening the flow canal (4) in which the sand (5) travels.
Figure 2:
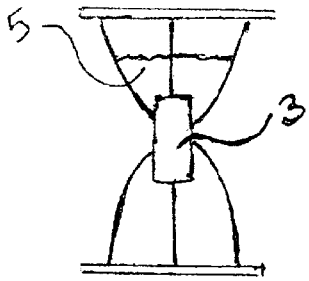
FIG. 2 is a side view of FIG. 1 showing the press areas (3) conveniently provided, however, not required for function, of the flexible clear premolded basic shape (1) of the hour-glass.

With continued reference to the drawings, the hour-glass (1) of the present invention includes an hour-glass housing formed of a premolded clear flexible polymer or similar material having an upper compartment (6) and a lower compartment (7) which are integrally connected by a flow canal (4), wherein the flow canal (4) defines an opening of a size to normally permit a controlled rate of flow of the sand (5) or other like substances from one compartment to another, and a means (3) for selectively opening the flow canal (4) so as to permit an unobstructed flow of the sand (5) or other like substances from one compartment to another, wherein said means (3) for selectively opening said flow canal (4) includes means for manually applying pressure radially on the sides of the flow canal of the flexible polymer housing of the hour-glass (1) and permitting an increase of the rate of flow of the sand (5) or other like substances from one compartment to another.

Figure 3:
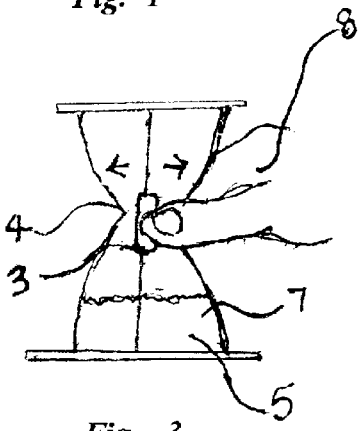
FIG. 3 is a perspective side view of the process of a person (8) pressing the press areas (3) represented in FIG. 2 and opening the flow canal (4) to allow the sand (5), to flow into the lower compartment (7)
Figure 4:
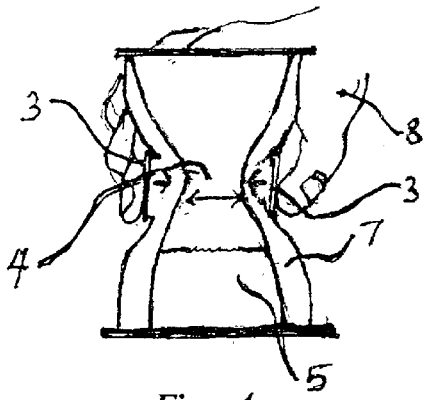
FIG. 4 is a perspective front view of FIG. 3, of a person (8) pressing the press areas (3), represented in FIG. 2 and opening the flow canal (4) to allow the sand (5) to flow into the lower compartment (7)
Figure 5:
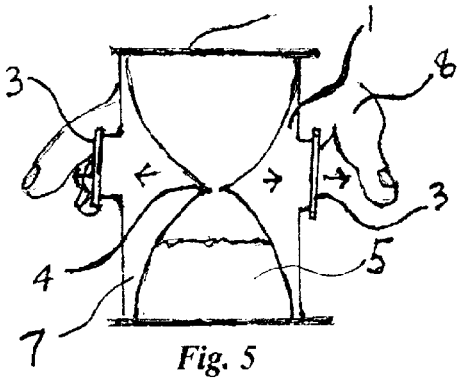
FIG. 5 is a prospective front view of a person (8) releasing the press areas (3) represented in FIG. 2 of the flexible clear premolded polymer shape represented in FIG. 1, and allowing the flow canal (4) to renew it's original shape after the sand (5) has filled the lower compartment (7).

The present invention is the method of transferring sand (5) or other appropriate materials used in hour-glass (1) employs molding clear flexible polymer or like material into an hour-glass basic shape (1) FIG. 1 in which by putting pressure on the sides (3) FIGS. 3–4 allow the sand (5) in the upper compartment (6) FIG. 1 to run into the lower compartment (7) FIG. 5 this opens the flow canal (4) FIGS. 3–4 due to the flexibility of the molded flexible polymer shape (1) FIG. 1 by releasing the pressure on the sides (3) FIG. 5 the clear flexible hour-glass will return to it's original shape. When in use the flow canal (4) of the hour-glass (1) will stay in a normal position allowing the flow canal (4) to continue to function for measuring the desired time. By pressing on the sides of the flow canal (4) made of the flexible material as described here within, one can save the time normally involved in waiting for the sand (5) or other substances to fill the lower compartment (7), as the flow canal (4) will open, allowing thus the sand (5) or other substances to flow freely. Thus, by pressing the sides of the above said flexible premolded form, the size of the original flow canal (4) will substantially increase, allowing the lower compartment (7) to be quickly filled and one can begin using the hour-glass (1) immediately, as the hour-glass (1) will return to its original shape when the pressure is released. Thus, creating the ability for immediate use when using this new improved hour-glass when measuring time; for games, cooking or other endeavors. Having thus described in detail the preferred apparatus which embodies the concepts and principles of the invention and which accomplishes the various objects, purposes and aims thereof, it is to be appreciated and will be apparent to those skilled in the art.

What I claim as my invention is:

1. A method for improving the time it takes for sand or other like substances to flow from an upper compartment to a lower compartment of an hour-glass, the method comprising the steps of:

providing an hour-glass having:

a housing formed of a premolded clear flexible polymer or similar material in the shape of the hour-glass which can increase the time in which the sand or other like substances can run through a flow canal of the hour-glass;

applying pressure on the sides of the flow canal of the flexible polymer housing of the hour-glass and thus opening the flow canal allowing the sand or other like substances to run freely and fill the desired compartment of the hour-glass;

releasing the pressure on the sides of the flow canal of the flexible polymer housing of the hour-glass and thus allowing the flow canal to return to an original form.

2. A method according to claim 1 wherein the step of applying pressure on the sides of the flow canal allows the sand or other like substances to flow quickly in order to pass through from the upper compartment to the lower compartment of the hour-glass at a faster speed than normally and improving the waiting time between uses.

3. An hour-glass device in which sand or other like substances flow from an upper compartment to a lower compartment of the hour-glass comprising:

a housing formed of a premolded clear flexible polymer or similar material in the shape of the hour-glass;

a flow canal disposed between the upper compartment and the lower compartment of the hour-glass, said flow canal defining a hole of a size to normally permit a controlled rate of flow of the sand or other like substances from one compartment to another, and means for selectively shifting the flow canal generally radially for selectively opening the flow canal so as to permit an unobstructed flow of the sand or other like substances from one compartment to another.

4. The hour-glass device of claim 3 in which said means for selectively opening said flow canal includes means for applying radial pressure on the sides of the flow canal of the flexible polymer housing of the hour-glass and permitting an increase of the rate of flow of the sand or other like substances from one compartment to another.

* * * * *

UNITED STATES PATENT AND TRADEMARK OFFICE

CERTIFICATE OF CORRECTION

PATENT NO. : 6,799,885 B2
APPLICATION NO. : 09/900599
DATED : October 5, 2004
INVENTOR(S) : Bryant It is certified that error appears in the above-identified patent and that said Letters Patent is hereby corrected as shown below:

On the Title Page

Item [73] should read as follows:

[73] Assignees: STEAG Microtech GmbH (Germany) and IMEC (Belgium)

Signed and Sealed this

Twenty-first Day of October, 2008

JON W. DUDAS
*Director of the United States Patent and Trademark Office*